US006117013A

United States Patent [19]

Eiba

[11] Patent Number: 6,117,013

[45] Date of Patent: Sep. 12, 2000

[54] PLAYING DEVICE SYSTEM

[76] Inventor: Peter Eiba, Hunnenstrasse 3, 86343 Königsbrunn, Germany

[21] Appl. No.: 08/875,572

[22] PCT Filed: Jan. 25, 1996

[86] PCT No.: PCT/EP96/00306

§ 371 Date: Jul. 25, 1997

§ 102(e) Date: Jul. 25, 1997

[87] PCT Pub. No.: WO96/23289

PCT Pub. Date: Aug. 1, 1996

[30] Foreign Application Priority Data

Jan. 27, 1997 [DE] Germany ..... 195 02 613

[51] Int. Cl.[7] ..... A63F 9/24

[52] U.S. Cl. ..... 463/41

[58] Field of Search ..... 463/40, 41, 42, 463/16; 700/90–93; 273/138.1, 138.2, 139

[56] References Cited

U.S. PATENT DOCUMENTS

| | | |
|---|---|---|
| 4,494,197 | 1/1985 | Troy et al. . |
| 4,669,730 | 6/1987 | Small . |
| 5,326,104 | 7/1994 | Pease et al. . |
| 5,340,119 | 8/1994 | Goldfarb . |

FOREIGN PATENT DOCUMENTS

| | | |
|---|---|---|
| A1 0015081 | 1/1980 | European Pat. Off. . |
| 0450520 | 10/1991 | European Pat. Off. . |
| 0620688 | 10/1994 | European Pat. Off. . |
| 3522136A1 | 6/1985 | Germany . |
| 4136065 | 5/1993 | Germany . |
| 2161629A | 1/1986 | United Kingdom . |
| 8902139 | 3/1989 | WIPO . |
| WO94/11696 | 5/1994 | WIPO . |
| WO94/25928 | 11/1994 | WIPO . |

*Primary Examiner*—Mark A. Sager
*Attorney, Agent, or Firm*—Hickman Stephens Coleman and Hughes, LLP

[57] ABSTRACT

A playing device system can be used by a number of players with various playing devices at a distance from each other. Each of these devices can be connected to a common host computer via a remote data transmission system and they are controlled by a random symbol generator which determines a winning combination of symbols. In order to simplify the system, the symbol generator is assigned to the host computer, with the playing devices constituting a display indicating the winning combination of symbols generated by the random symbol generator and connected with an input device to participate in the continuous determination of the winnings.

13 Claims, 1 Drawing Sheet

PLAYING DEVICE SYSTEM

BACKGROUND OF THE INVENTION

This invention relates to a game device system with the features of the pre-characterizing part of claim 1.

Such a game device system is known from WO 94/11696 for example, wherein it is proposed, in order to set up competitions, especially of electronic darts, or to make it possible for players living at distances to play together, to connect together spatially separate game devices by means of data telecommunications and to synchronise the games console displays to display the game results. The data telecommunication between the individual game devices is preferably effected over the telephone network. A central computer can also be connected to the data telecommunication system in order to evaluate the game results of all the game devices.

A similar system for playing on a plurality of amusement devices remote from one another is known from WO 94/25928, wherein a bidirectional connecting line is provided between the game devices. The amusement or game devices are here also connected together or networked via modems and data telecommunications lines. Thus the data relevant to the game can also be displayed directly at the other devices, whereby the results of the game opponents can be compared with one another and can be represented in the respective displays of the game devices as sum or difference results. This game device system is designed especially for amusement arcades, wherein the input and output signals of the amusement devices concerned are processed by a central computer, so that central control and allocation of the monetary stakes is facilitated. Moreover the data telecommunication line can also be connected to a separate personal computer of an organiser, which facilitates the data evaluation directly by the automatic organiser.

An electronic competition system is further known from DE 3 522 136 (=GB-A 2 161 629), using video games devices, which each comprise a display device and are connected through a data line to a central computer. The identification data of the individual players and their credit are stored in the central computer. Each player holds a card containing his identification, which he inserts into a card reader of the games device before beginning a game. The computer evaluates the game results after the credit checking and the go-ahead and determines a winner. These data on the winner are then fed over the data line to the individual games devices and are displayed there.

A game device system is further known from EP-A 0 015 081 wherein a plurality of game devices are connected through data telecommunications, for example a telephone line, to a central computer. Program information emanating from the central computer is sent to the individual game devices, in order to alter the game variants. The data telecommunications can also be used to send the game results attained at the individual game devices to a central computer, for example in order to determine the game frequency, the winning frequency and the like at an individual device.

It is common to all these game systems that the game devices are relatively expensive. Thus, each game device requires at least an input device in the form of a joystick for video game devices, an electronic dartboard for electronic darts or a keyboard for a gambling machine, a random generator and a device for receiving money and paying out money. Moreover, interfaces, modems and the like are necessary for connection to the central computer. These components of the game device are in part of quite complicated construction and also require complex monitoring and checking in the case of gambling machines with an integrated random generator. This monitoring and possibly servicing at regular intervals prescribed by the lawgiver is however very expensive, since the technical personnel have to travel to the sites of the individual game devices for this. Making arrangements with the owner of the restaurant in which such the gambling machine is installed for example is frequently difficult, so that such a visit is frequently only possible in the evening or at night during the opening time of the restaurant.

SUMMARY OF THE INVENTION

Accordingly the invention is based on the object of providing a game device system with a plurality of game devices arranged remote from one another, wherein the game devices and thus the system as a whole are of substantially simpler construction and which nevertheless facilitates supra-regional participation in the game events.

This object is met by the game device system according to the features of claim 1.

By arranging the (single) random generator in the central computer, which is connected to a plurality of associated game devices by data telecommunications, a substantial reduction in the device cost can be attained. Thus the random generator can for example control for example hundreds or even thousands of connected game devices at the same time, in parallel or in synchronous manner. It is significant that the game devices themselves only require a minimum specification, merely in the form of a display, in order to display the winning symbol combination determined by the random generator, and a coupling-in device in order to facilitate the connection to the central computer for participation in the determination of winners. This connection or coupling-in device, e.g. in the form of a magnetic card reader, serves in the preferred manner also to identify the player.

This advantageous identification takes place through the coupling-in device integrated in the respective game device or arranged in its immediate vicinity, with which the player enters into the continuously running game and thus also the determination of winners. In addition an automatic, cashless debiting of a predetermined participation fee for the game is advantageously carried out on-line, or in the case of a win a corresponding credit is likewise credited on line. Instead of this preferred on-line booking however, a buffered debiting or crediting can be effected through a value card (chip card).

The proposed game device system with a plurality of game devices set up or located remote from one another is suitable in particular for implementing a numbers lottery, whereby a significant increase in the frequency of the "draw" of the winning symbol combination is possible, compared with the current weekly or half-weekly running. Thus for example determination of the winning number and its display can be carried out e.g. every minute, so that the game requirements of a lot of game participants can be fulfilled. In addition the simultaneous participation of a lot of potential players in several countries or even worldwide is possible.

In a particularly preferred arrangement an already existing electronic device can serve to display the determined winning symbol combination, for example a personal computer, a laptop, a car telephone or a portable telephone (Handy). The identification of the participating players is also made substantially easier, so that the debiting of the predetermined participation fee can take place in a particularly simple manner on-line. This participation fee, predetermined or for example varying with the time of day, can be covered by the usual telephone charges for the different ranges of utilisation. Thus a particularly advantageous possibility of utilisation for existing data transmission systems arises for the telephone network or radio network operator, since a specially low participation fee can be offered in low usage times, for example at night, in order to create an incentive to play. Likewise the chances of winning or the amount of the payout can be suitable increased with the participation fee remaining the same.

A telephone or data transmission satellite can serve as the central computer in a particularly advantageous manner, since a lot of potential game participants are then reached. The identification of the game participants is effected in the case of a radio telephone by the so-called PIN number, so that the debiting of the participation fee and the association of a possible win with the right person is effected. In the preferred arrangement of the game system as a numbers lottery the last digit of the personal PIN code for example can serve as "ticket number". However the identity card with a corresponding identification number, a magnetic card, a bank card or credit card or the current telephone number of the game participant can also serve as the coupling-in element. Instead of the last digit however, the first digit or the fourth, fifth or sixth place of the corresponding number can serve as the winning criterion. The current game variant (e.g. "Last digit wins; winning chances 1:9" etc.) can be shown on the display of the game device, whether it be the display of the telephone, the screen of the PC or a display of a specially provided game device. Likewise, blocks of numbers, digits or letters, for example the first letter of the family name can serve as the winning criterion "drawn" by the random generator and serve to identify the game participant. These association data are entered into the central computer through the coupling-in element and after the "draw" by the random generator is determined straightway, so that the corresponding win assignment can be effected via the respective telephone number, bank account number or the like, in the manner of "electronic banking".

All in all a game device system usable in a simple way by a lot of participants results, wherein in particular already existing electronic devices, such as a PC or telephone are suitable for participation in the game device system. Letters or numbers lotteries or a combination thereof can thereby be run significantly more frequently and in addition the participant can take part in the current "draw" in the simplest manner, such as dialling a telephone number. The player does not therefore have to visit suitable businesses, fill in the lottery ticket, monitor the draw and cash the winnings. A particularly simple game system results from this, which is furthermore significantly more favourable in terms of management expenses because of the data communications paths for the most part in existence and the existing communications devices, so that correspondingly higher payouts can be attained. In addition, particularly when the central computer and the random generator are arranged in or in the vicinity of a transmitter mast or a telecommunications satellite, there is the possibility of better utilisation of existing communications devices.

BRIEF DESCRIPTION OF THE DRAWINGS

A preferred embodiment of the invention will be explained in more detail and described below with reference to the drawings, in which:

FIG. 2 is an enlarged representation of the display of the game device, which can also be in the form of the display on a television screen, a mobile telephone, a computer screen or the like.

DESCRIPTION

Figure 1:
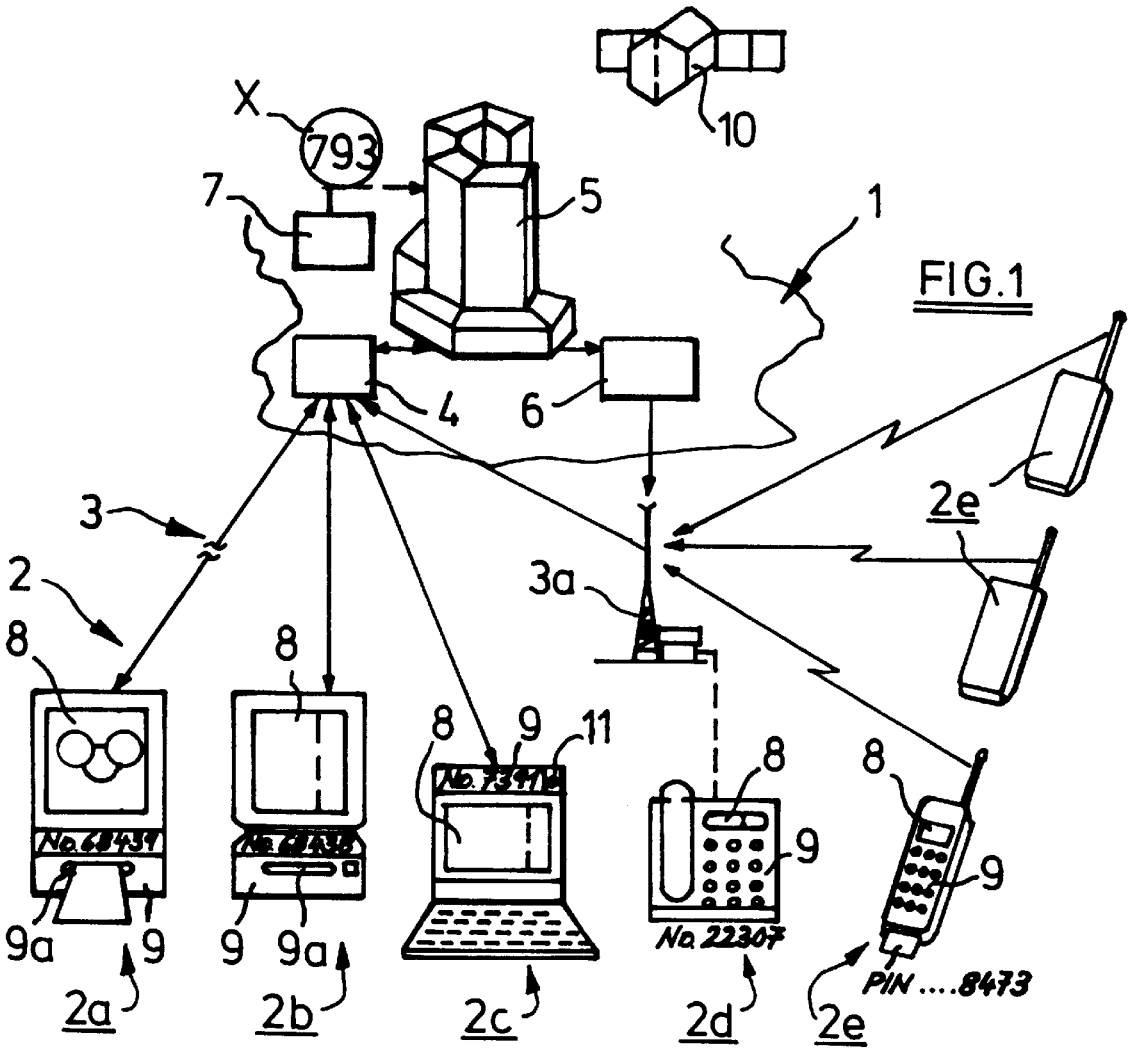
FIG. 1 is a schematic overall view of the game device system.

An overall view of the game device system 1 is shown in FIG. 1, wherein there is provided a plurality of game devices 2. The number of game devices 2 can encompass some thousands or more, since already existing electronic devices can be used in a simple way as the game devices 2. As well as a specially designed game device 2 in the form of a game machine 2*a*, as is also used in particular for installation in amusement arcades for public use, substantially conventional television sets 2*b*, personal computers 2*c*, fixed telephones 2*d*, mobile telephones 2*e* and like personal data transmission devices can be uses as game devices 2. The display 8 in the implementation as a game machine 2*a* is shown in the form of overlapping discs but can also be formed as a bright band, a bright ring or the like, in order to retain the usual screen appearance. As a requirement for suitability as a game machine 2 there is needed only a device for data telecommunications 3 and a display or screen 8 for reception of the determined winning symbol. The data telecommunication link 3 can be wired, in particular over the telephone network, or can be wireless in the case of mobile telephones 2*e*. The game devices 2 are connected over the data telecommunication link 3 to a receiver 4 for the data sent from the game devices 2 and thus to a central computer 5, preferably formed by a high performance computer with high processing speeds and large memory capacity. Furthermore, a transmitter 6 is connected to the central computer 5 and transmits the winning combinations, for example winning numbers, winning symbols or winning letters or combinations thereof to the displays 8 of the game devices 2. The winning symbols are determined or "drawn" by a single, central random generator 7. The winning symbols can also be symbols known in the game machine sector, such as for example three cherries, three aces, three crowns, which are displayed on the disc or strip display of the game machine 2*a*. The command for the winning assignment , e.g. 5.0 DM for "drawing" three aces is issued to all connected game devices 2 by the central computer 5.

In the example shown here, the winning number is "793", to which a letter can be assigned as a further winning symbol combination. This determined winning symbol X is transmitted from the transmitter (or a plurality of transmitters) 6 through the bidirectional data telecommunication links 3 to the individually connected game devices 2 and is displayed there. At the same time, in the preferred arrangement of on-line winnings crediting, the participant data entered via the receiver 4 is indicated in the memory of the central computer 5 according to this winning combination and also the corresponding winning assignment is communicated over the data telecommunication link 3 when there is a win. In off-line winning advice, the win is credited to the inserted value card.

The data telecommunication link 3 can by effected also through a plurality of regional interposed transmitter stations 3*a*. The unit formed by the receiver 4, central computer 5, transmitter 6 and random generator 7 can also be arranged in the transmitter station 3*a*, even in another state via further data connections, for example overseas, or even in a telecommunications satellite 10 indicated here. A very large number of potential participants can thus be reached. The telecommunications satellite 10 can be fixed in an orbit circling the earth or in a geostationary orbit.

In order to participate in the continuously running determination of winners by the random generator 7, for example every minute, a connection or coupling-in device 9 is provided at each game device 2. This coupling-in device 9 is preferably formed as a card reader, as is indicated here by the card insertion slot 9*a*. A value card, especially a so-called chip card with a value of 100.00 DM for example can be inserted, through which coupling-in and participation in the game is effected. The winnings received can be credited directly to the account, so that the player can redeem this again at the selling point.

In the preferred arrangement, the coupling-in device 9 further has a special registration number, where this registration number can also form the possibly winning number, insofar as this is "drawn" by the random generator 7. The registration number of the transmitting game device is captured by the receiver 4 and the central computer 5 on participation and, depending on the game variant, on agreement in the last digit for example, a corresponding winning assignment is transmitted via the transmitter 6 to this game device 2. Thus, when the winning number X agrees partially in some places or completely with the registration number as identification number, the inserted card in the card reader 9*a* of the coupling-in device 9 can be revalued for example, as will be described in more detail in connection with FIG. 2.

The connection or coupling-in device 9 can also be formed as a decoder with a specific registration number, as is shown in the embodiment 2*b* of the game device 2 in the form of a television receiver. The display 8 of the current winning number can be called up by teletext or similar devices. In the embodiment 2*c* as a personal computer the coupling-in device 9 can likewise be implemented by a modem with a specific registration number. The use of the personal computer also facilitates representation of the latest drawn winning numbers on the display 8, so that the user can wait for a suitable winning chance before coupling in to the data network. In addition the use of the personal computer 2*c* also offers the possibility to participate in the game with several participating numbers. For reasons of data security and prevention of misuse a key switch 11 can be provided on the modem as coupling-in device 9. Instead of transmission by means of a modem, a suitable transmitter can also be provided on the personal computer 2*c* for direct contact over a data network with the central computer 5. A particularly simple design of the coupling-in device 9 consists in the embodiment 2*d* as a fixed telephone, which has a telephone connection with the last number "22307". This telephone number associated in each case unambiguously with a person serves both as the "ticket number" and also for identification in the case of a winning assignment. In addition the telephone participant can clearly demonstrate to the game device system operator through the recording of telephone call data already customary for the most part, such as start time, finish time, called number, that he was coupled in to the game device system 1 at a specific time and was thus in a specific winning game in the game device system 1, for example at 20.38 hours and the final number "307" was here drawn for example. The winning numbers determined by the random generator 7 can also be shown in association with the "draw minute" in the daily paper or via teletext in neutral media, for closer inspection.

With the embodiment 2*e* of the game device 2 as a mobile telephone simple and problem free coupling in and participation in the game device system 1 is also possible. Through this direct determination of a possible winner is possible on-line through the normal magnetic card, for example with the personal identification number with the last number "8473", since the transmitter data relative thereto have been determined and stored in the central computer 5 from the mobile telephone 2*e* via the receiver 4, before the "draw" of the winning number by the random generator 7. By a return transmission by means of the transmitter 6 the winning number and also for example the match in the final digit "3" can be indicated to the game participant. The participant fee for the game is preferably debited through the normal telephone subscriber charge. Instead of allocating a specific amount of money, with smaller wins free units can equally be given. With larger winnings, the amount won can be shown on the display 8 of the mobile telephone 2*e* and a corresponding confirmation and remittance be sent to the participant. An alternative here is that the winning amount is credited to an account known to the game device system 1 by means of the central computer 5. The debiting or crediting of winnings is preferably effected via a connected bank for reasons of data security. The use of a credit card or a bank card as the coupling-in element in the card insertion slot 9*a* in the coupling-in device 9 is especially suitable for this, since the bank connection is present in coded form and the corresponding winning association can be effected via the credit institute. Since such credit cards or bank cards are already very widespread, these cards are especially suitable for participation in the game, since unambiguously associated last digits are issued with credit cards by the company for payment systems. The winning person can then be unambiguously identified independently of the registration number of the coupling-in device or the modem or the telephone number.

Figure 2:
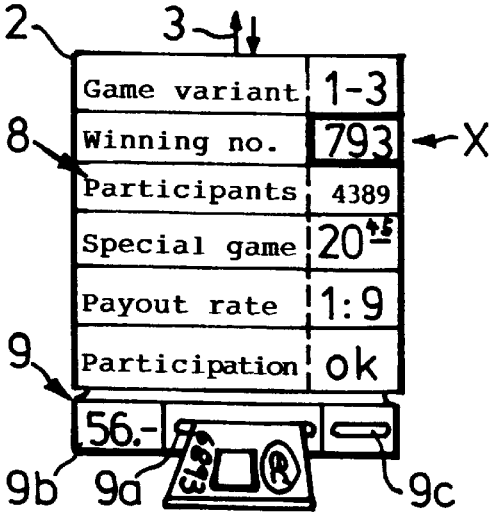

A display 8 such as may be used with one of the game devices 2*a* to 2*e* is shown in FIG. 2. Firstly there is displayed the game variant being played at the moment, for example that here the last three digits of an identification number win, whether it be a registration number, the decoder number, the telephone number or the PIN number. In addition winning with appropriate letters for the first letter of the family name could be used for example as an additional winning variant. Furthermore the last winning number X, here for example the number "793" is shown on the display 8. In order to estimate the winning chances the current number of participants which are coupled in to the game system at the moment can also be displayed, also further data relevant to playing the game, such as the next special or joker game to be played. Furthermore the chance of a win, for example with agreement of the final digit of e.g. "1 in 9" are displayed for the potential game participant. In the game variant with letters additionally determined by the random generator 7 for the initial letters of the family or forename, the winning chances can be given as "1 in 200". These winning chances are formed essentially like those in roulette or in numbers lotteries, so that relatively high winning odds are paid out already with agreement of the last three digits.

The above-described display 8 on the display or screen can be present continuously in the implementation as an amusement arcade device 2*a* while this display can be called up on a television set according to the implementation 2*b* via a specific channel or teletext. The same applies to the call-up possibilities with the game devices 2*c*, 2*d* and 2*e*, wherein the display 8 can be called up via a favourable telephone tariff. Further game information can be included, for example the current time of day, the rhythm of the game, e.g. every minute and other indications, such as the number of participants, the number of previous wins, the latest payout rates or the last twenty winning numbers. These data are constantly updated by the game device system 1.

When the player has decided to participate, he can insert a suitable value card or his personal credit or bank card in the coupling-in device 9, optionally by typing in an additional numerical code and is thus connected into the game device system 1 or coupled-in. The same is effected after dialling a specific telephone number with the devices according to the embodiments 2*d* and 2*e*. The participant receives confirmation that he is participating in the next "draw", while the corresponding participation fee is debited to the value or credit card inserted in the card insertion slot 9*a*. Likewise the personal data, accordingly the "ticket number" are fed over the data telecommunication link 3 to the central computer 5, via the receiver 4. A specific time limit is set for each game for entering and registering as a player, for example the first thirty seconds of a minute with a game a minute. The winning number X is then determined by the random generator 7 and the winners or the winning devices 2 are determined by means of the central computer 5 and are informed. With presence of a credit or bank card the winning payment can then be effected on-line directly to the personal account. If a value card is used, e.g. in the form of a conventional telephone card, the winning amount can be credited or additional free units can be given for using a data network, such as the Internet for example, for special plays. In the case of amusement arcade devices, which are basically publically accessible, an account state display 9*b* can additionally be provided and also a printer 9*c*, with which a possible win is documented, e.g. by "drawing" three aces by the random generator 7 and corresponding display on the electronic three disc display of the game machine 2*a* shown here. The player with such a voucher can then get the corresponding winnings which are credited on the value card payed out from the amusement arcade operator. This value card with a nominal value of 100.00 DM for example has the additional advantage that the player himself remains anonymous when playing the game machine 2*a* and the data telecommunication link 3 is relieved from on-line accounting operations.

However, the winning transactions are preferably carried out directly through a bank or an account, especially with larger amounts, the owner being identified by the credit card number or PIN number. As an alternative however, a suitable account can be set up also with the game device system operator. Specific maximum payments per day can be determined for security, of 500.00 DM for example, as with gaming banks.

A very high data throughput results from the described game system, even with thousands of players, so that the individual determinations of winners can be carried out within seconds. Because of this there is a significantly greater frequency of draws compared with the usual numbers lotteries and hence of winning possibilities. In addition, the system is distinguished by especially simple handling and user-friendliness, so that this game device system 1 can especially be integrated in data networks such as the Internet by the respective operators ("providers").

What is claimed is:

1. A game device system (1) comprising a plurality of game devices (2) remote from one another, which can each be connected to a common central computer (5) by an associated data telecommunications link (3) and which are controlled by a random generator (7) for determining a winning symbol combination (X), wherein the random generator (7) is associated with the central computer (5), wherein the game devices (2) are each formed as a display (8) for the winning symbol combination (X) issued by the random generator (7) and are connected to a coupling-in device (9) for participation in the continuously running determination of winners, and wherein the central computer (5) and the associated random generator (7) are arranged in a telecommunications satellite (10).

2. A game device system according to claim 1, wherein the coupling-in device (9) is formed by a card reader (9*a*) for reading a personal identification card.

3. A game device system according to claim 2, wherein the identification card is formed by a credit card.

4. A game device system according to claim 2, wherein the coupling-in device (9) has a specific registration number.

5. A game device system according to claim 4, wherein the registration number is formed by the telephone number of a fixed telephone (2*d*) or a mobile telephone (2*e*).

6. A game device system according to claim 1, wherein the game device (2) is formed by a television set with an associated decoder (2*b*).

7. A game device system according to claim 1, wherein the game device (2) is formed by a personal computer (2*c*) with a modem for connection to the data telecommunications link (3).

8. A game device system according to claim 1, wherein the game device (2) is formed by a fixedly connected telephone (2*d*).

9. A game device system according to claim 1, wherein the game device (2) is formed by a mobile telephone (2*e*).

10. A game device system according to claim 1, wherein the coupling-in device (9) comprises a record printer (9*c*).

11. A game device system according to claim 1, wherein the coupling-in device (9) comprises an account state display (9*b*).

12. A game device system according to claim 1, wherein the central computer (5) is connected to an automatic cashless winnings crediting device.

13. A game device system according to claim 1, wherein the payment of the participation fee to the continuously running winnings determination of winners is effected by debiting one or more telephone units.

* * * * *